US010499779B2

(12) United States Patent
Muir et al.

(10) Patent No.: US 10,499,779 B2
(45) Date of Patent: Dec. 10, 2019

(54) VACUUM CLEANER

(71) Applicant: BLACK & DECKER INC., New Britain, CT (US)

(72) Inventors: Derek Muir, Durham (GB); Andrew Walker, Durham (GB); Cavan Grey, County Durham (GB); Jack Richardson, Yorkshire (GB)

(73) Assignee: Black & Decker, Inc., New Britain, CT (US)

( * ) Notice: Subject to any disclaimer, the term of this patent is extended or adjusted under 35 U.S.C. 154(b) by 107 days.

(21) Appl. No.: 15/805,959

(22) Filed: Nov. 7, 2017

(65) Prior Publication Data

US 2018/0132686 A1 May 17, 2018

(30) Foreign Application Priority Data

Nov. 17, 2016 (EP) ..... 16199417
Aug. 9, 2017 (EP) ..... 17185648

(51) Int. Cl.
*A47L 9/10* (2006.01)
*A47L 9/28* (2006.01)
(Continued)

(52) U.S. Cl.
CPC ..... *A47L 9/108* (2013.01); *A47L 9/2805* (2013.01); *A47L 9/2842* (2013.01); *A47L 9/325* (2013.01); *A47L 9/1666* (2013.01)

(58) Field of Classification Search
None
See application file for complete search history.

(56) References Cited

U.S. PATENT DOCUMENTS 8,528,163 B2 * 9/2013 Park ..... A47L 9/0081 15/352
2006/0123749 A1 6/2006 Park
(Continued)

FOREIGN PATENT DOCUMENTS

EP 1671569 6/2006
EP 1671570 6/2006
(Continued)

OTHER PUBLICATIONS

EP Search Report dated May 12, 2017, relating to EP Application No. EP16199417.
(Continued)

*Primary Examiner* — David Redding
(74) *Attorney, Agent, or Firm* — John Yun

(57) ABSTRACT

A vacuum cleaner comprising: a housing; a motor fan assembly arranged to generate an air flow; a dirt container in fluid communication with a dirty air inlet and the motor fan assembly; a moveable dirt compactor mounted in the dirt container and moveable between a stowed position and a dirt compacting position wherein the moveable dirt compactor is closer to one end of the dirt container in the dirt compacting position than in the stowed position, wherein the movable dirt compactor is shaped so as to allow dirt within the dirt container located on one side of the dirt compactor to pass to the other side of the dirt compactor; and a detector switch coupled to the moveable dirt compactor, the detector switch configured to open an electrical circuit and interrupt power supplied to the motor fan assembly when the moveable dirt compactor moves towards the dirt compacting position and urges dirt towards the one end of the dirt container.

20 Claims, 7 Drawing Sheets

(51) Int. Cl.
*A47L 9/16* (2006.01)
*A47L 9/32* (2006.01)

(56) References Cited

U.S. PATENT DOCUMENTS

| | | | | |
|---|---|---|---|---|
| 2008/0263815 | A1 | 10/2008 | Oh et al. | |
| 2009/0229072 | A1* | 9/2009 | Hwang | A47L 5/365 15/352 |
| 2009/0241286 | A1* | 10/2009 | Hwang | A47L 5/365 15/347 |
| 2010/0206173 | A1* | 8/2010 | Oh | A47L 9/108 96/424 |
| 2012/0255140 | A1 | 10/2012 | Tomita et al. | |

FOREIGN PATENT DOCUMENTS

| | | |
|---|---|---|
| EP | 1733669 | 12/2006 |
| EP | 1987753 | 11/2008 |

OTHER PUBLICATIONS

EP Search Report dated Mar. 21, 2018, for EP Application No. 17185648.7.

* cited by examiner

VACUUM CLEANER

CROSS-REFERENCE TO RELATED APPLICATION

This application claims priority to European Patent Application No. 16199417.3 filed Nov. 17, 2016 and European Patent Application No. 17185648.7 filed Aug. 9, 2017. The entire contents of those applications are expressly incorporated herein by reference.

FIELD OF THE INVENTION

The present invention relates to a vacuum cleaner. In particular the present invention relates to improved dust container capacity.

BACKGROUND OF THE INVENTION

Vacuum cleaners typically have an on board dirt container for receiving and storing dirt and debris that has been sucked up from a surface that is being cleaned. Periodically the dirt container must be emptied and this can be an undesirable task for the user. It is known to increase the volume of the dirt container by providing a compaction mechanism in the dirt container. Examples of compaction mechanisms are shown in EP 1 671 569 and US 2008/0263815. This squashes the contents of the dirt container and increases the effective volume of the dirt container and means that the dirt container can be emptied less frequently.

A problem with the compaction mechanisms is that dirt and debris can accumulate above the compaction mechanism and interfere with the functionality of the compaction mechanism. This means that the compaction mechanism can become less effective or even inoperable.

Embodiments of the present invention aim to address the aforementioned problems.

SUMMARY OF THE INVENTION

According to a first aspect of the present invention there is a vacuum cleaner comprising: a housing; a motor fan assembly mounted in the housing, the motor fan assembly arranged to generate an air flow; a dirt container mountable on the housing and in fluid communication with a dirty air inlet and the motor fan assembly; a moveable dirt compactor mounted in the dirt container and moveable between a stowed position and a dirt compacting position wherein the moveable dirt compactor is closer to one end of the dirt container in the dirt compacting position than in the stowed position; wherein the vacuum cleaner comprises a detector switch coupled to the moveable dirt compactor, the detector switch configured to open an electrical circuit and interrupt power supplied to the motor fan assembly when the moveable dirt compactor moves towards the dirt compacting position and urges dirt towards the one end of the dirt container.

This means that the motor fan assembly is not operational when the dirt compactor is in a compacting position. This means that a dirty air flow cannot intercept the dirt compactor during use of the dirt compactor. This means that dirt and debris sucked up from a surface to be cleaned is less likely to contaminate the mechanism of the dirt compactor. This means the dirt compactor requires less maintenance.

Preferably the detector switch is configured to close the electrical circuit and supply power to the motor fan assembly when the moveable dirt compactor is in the stowed position. In this way the detector switch is mechanically coupled to the movement of the dirt compactor. This provides a reliable and cost effective arrangement. Alternatively or additionally the detector switch can be other types of detectors such as an optical detector, or a moving magnet and a hall sensor, a reed switch and a moving magnet or any other electrical sensor to detect movement of the dirt compactor.

Preferably wherein the moveable dirt compactor is coupled to the detector switch with an elongate mechanical linkage. The elongate mechanical linkage transfers the force from a handle to the dirt compactor. At the same time the physical movement that actuates movement of the dirt compactor can also be used to detect the movement of the dirt compactor.

Preferably a dirt separator mounted in the dirt container is located in an air flow path between the dirty air inlet and the motor fan assembly. This means the dirt separator such as a filter is nested within the dirt container. This makes the vacuum cleaner unit more compact and portable.

Preferably the moveable dirt compactor sweeps a surface of the dirt separator when the moveable dirt compactor moves from the stowed position to the dirt compacting position. This means that the outer surface of the dirt separator remains free from accumulated dirt and debris because the dirt separator is cleaned each time the dirt compactor is operated. This improves the air flow through the dirt separator and the efficiency of the vacuum cleaner unit.

Preferably the moveable dirt compactor engages an inner surface of the dirt container. The dirt compactor scrapes dirt between the wall of the dirt container and the dirt separator. This means that accumulated hair is pushed out of a relatively narrow space into the open space of the dirt container where the dirt separator is not located by the dirt compactor. This avoids the user having to manually remove dirt and debris from the dirt container with their hands.

Preferably the dirty air inlet is mounted on a wall of the dirt container between the moveable dirt compactor in the stowed position and the one end of the dirt container. This means that dirt and debris are not sucked into the dirt container when the dirt compactor is operational. This prevents dirt accumulating and contaminating the mechanism of the dirt compactor.

Preferably the moveable dirt compactor is actuated with a moveable handle mounted on the exterior of the dirt container. The moveable handle allows the user to gain purchase and exert the necessary force to move the dirt compactor between the stowed and compacting positions.

Preferably the moveable dirt compactor is biased towards the stowed position. In this way the dirt compactor automatically returns to the stowed position after being operated.

Preferably a spring is mounted in the handle for biasing the moveable dirt compactor to the stowed position. By placing the spring inside the handle, the biasing mechanism can be compact.

Preferably the one end of the dirt container comprises a door for emptying the dirt container. This means that the dirt compactor can be used to compact the dirt in the dirt container but also help empty the dirt container when the door is open.

Preferably the door comprises a detent for maintaining the door in an open position and the dirt container comprises a first latch for releasing the door. This means that the user can easily open the door during an emptying operation.

Preferably the dirt container is removeable from the housing. By removing the dirt container from the housing, the user does not need to lift the weight of the battery and the motor fan assembly during an emptying operation. Accordingly emptying the dirt container can be easier for the user.

Preferably the detector switch is mounted in the housing. This means that the detector switch is only operable when the dirt container is mounted in the housing. In this way the detector switch prevents operation of the vacuum cleaner unit when the dirt container is removed from the housing. This prevents dirt and debris contaminating the motor fan assembly when the filter or dirt separator is not present.

Preferably housing comprises a second latch for releasing the dirt container from the housing. This means that the dirt container is less likely to be accidentally released from the vacuum cleaner unit.

According to a second aspect, there is provided a vacuum cleaner comprising: a housing; a motor fan assembly arranged to generate an air flow; a dirt container in fluid communication with a dirty air inlet and the motor fan assembly; a moveable dirt compactor mounted in the dirt container and moveable between a stowed position and a dirt compacting position wherein the moveable dirt compactor is closer to one end of the dirt container in the dirt compacting position than in the stowed position, wherein the movable dirt compactor is shaped so as to allow dirt within the dirt container located on one side of the dirt compactor to pass to the other side of the dirt compactor; and a detector switch coupled to the moveable dirt compactor, the detector switch configured to open an electrical circuit and interrupt power supplied to the motor fan assembly when the moveable dirt compactor moves towards the dirt compacting position and urges dirt towards the one end of the dirt container.

The detector switch may be configured to close the electrical circuit and supply power to the motor fan assembly when the moveable dirt compactor is in the stowed position.

The moveable dirt compactor may be coupled to the detector switch with an elongate mechanical linkage.

The movable dirt compactor may comprise a top surface and a bottom surface, the bottom surface having a greater surface area than the top surface.

At least a portion of the top surface may contact the dirt container when the movable dirt compactor is in the stowed position.

The dirt compactor may comprise one or more sloping surfaces between the top surface and the bottom surface.

The dirty air inlet may be mounted on a wall of the dirt container between the moveable dirt compactor in the stowed position and the one end of the dirt container.

The moveable dirt compactor may be actuated with a moveable handle mounted on the exterior of the dirt container.

The moveable dirt compactor may be biased towards the stowed position.

A spring may be mounted in the handle for biasing the moveable dirt compactor to the stowed position.

The one end of the dirt container may comprise a door for emptying the dirt container.

The dirt container may be removeable from the housing.

The detector switch may be mounted in the housing.

The dirt compactor may comprise one or more open sections or holes for dirt to pass through.

According to a third aspect, there is provided a vacuum cleaner comprising: a housing; a motor fan assembly arranged to generate an air flow; a dirt container in fluid communication with a dirty air inlet and the motor fan assembly; and a moveable dirt compactor mounted in the dirt container and moveable between a stowed position and a dirt compacting position wherein the moveable dirt compactor is closer to one first end of the dirt container in the dirt compacting position than in the stowed position, wherein the movable dirt compactor is shaped such that dirt located above the dirt compactor and in the dirt container can pass below the dirt compactor when the vacuum cleaner is in the upright position or when the vacuum cleaner is in use.

BRIEF DESCRIPTION OF THE DRAWINGS

Various other aspects and further embodiments are also described in the following detailed description and in the attached claims with reference to the accompanying drawings, in which:

DETAILED DESCRIPTION OF INVENTION

Figure 1:
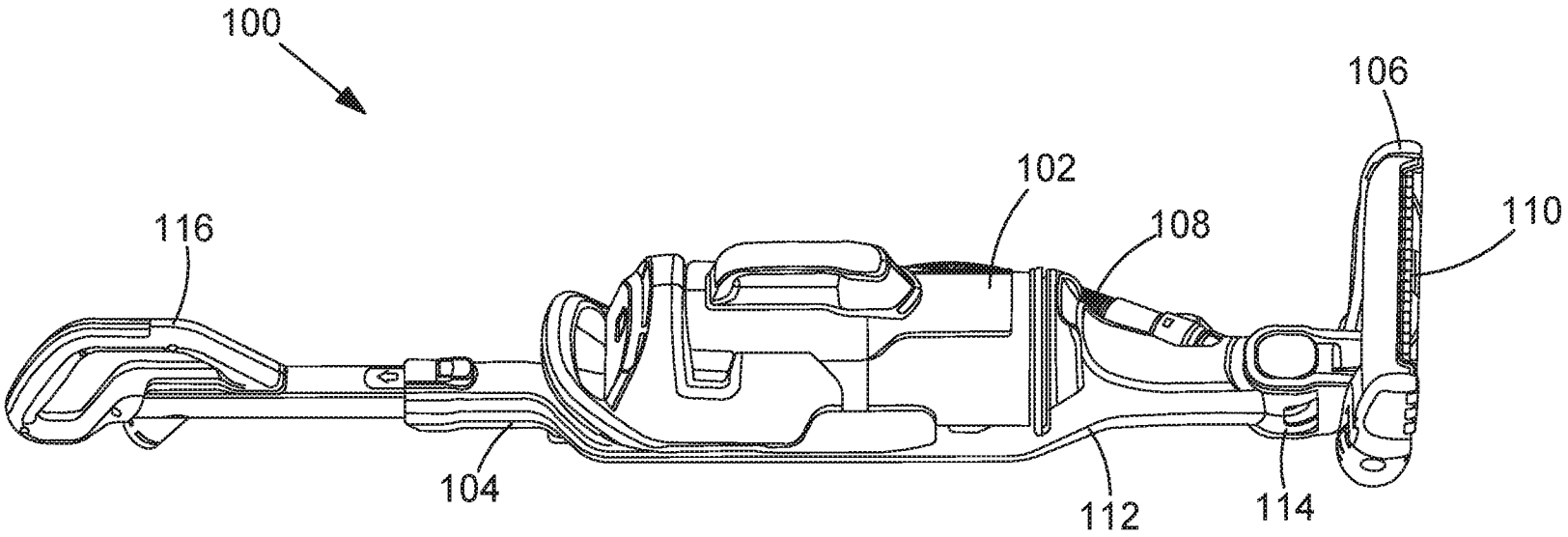
FIG. 1 shows a perspective view of the vacuum cleaner.

FIG. 1 shows a perspective view of a vacuum cleaner 100. The vacuum cleaner 100 comprises a vacuum cleaner unit 102 which is mounted in a chassis 104. The chassis 104 is optional. In this way the vacuum cleaner 100 is a stickvac type vacuum cleaner. In other embodiments the vacuum cleaner 100 can be any type of vacuum cleaner such as an upright vacuum cleaner, a canister vacuum cleaner or a handheld vacuum cleaner.

The chassis 104 comprises a floorhead 106 for engaging surfaces to be cleaned. The floorhead 106 has a floorhead dirty air inlet 110 which is in fluid.

communication with a hose 108 of the vacuum cleaner unit 102. The floorhead 106 is coupled to the chassis body 112 via an articulated joint 114. The articulated joint 114 permits the floorhead 106 to move with respect to the chassis body 112 in two degrees of freedom. The articulated joint 114 comprises two pivoting joints which have pivoting axes perpendicular to each other. The chassis also comprises a handle 116 for the user to grip and steer the vacuum cleaner 100 during use.

The vacuum cleaner unit 102 is releasably removeable from the chassis 104. The vacuum cleaner unit 102 comprises projecting ribs (not shown) which slot into a reciprocal recess (not shown) on the chassis 104. The vacuum cleaner unit is mountable on the chassis 104 and locked to the chassis 104 with a latch mechanism (not shown). The latch mechanism is operated when the vacuum cleaner unit 102 is to be released from the chassis 104.

Figure 2:
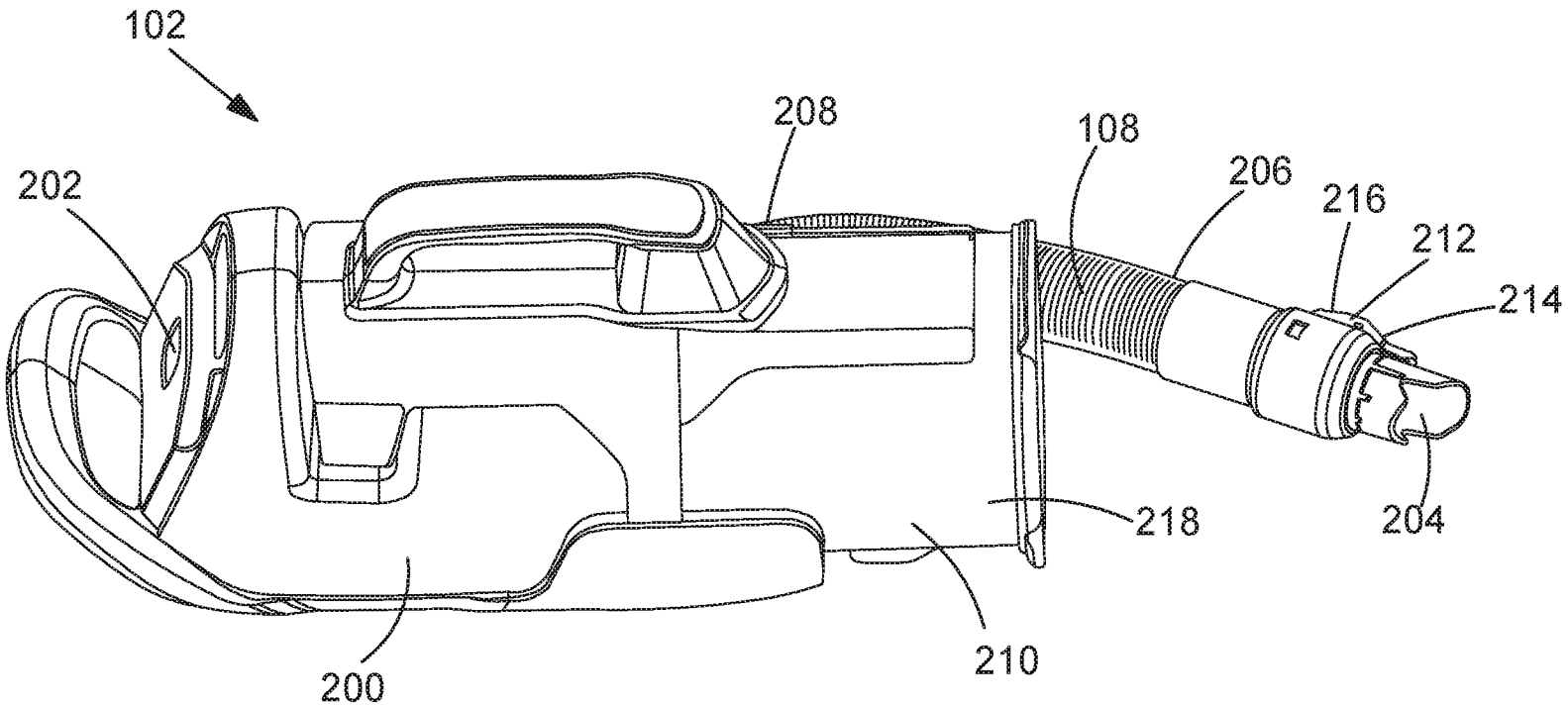
FIG. 2 shows perspective view of the vacuum cleaner.

The vacuum cleaner unit 102 will now be discussed in further detail in reference to FIG. 2. FIG. 2 shows a perspective view of the vacuum cleaner unit 102. The vacuum cleaner unit 102 is operable remote from the chassis 104. Optionally the vacuum cleaner unit 102 is a stand-alone unit which does not couple to a chassis 104 as shown in FIG. 1.

The vacuum cleaner unit 102 comprises a housing 200. The housing 200 comprises a clam shell type construction comprises two halves which are fastened together. The halves of the housing 200 are fastened together with screws but in alternative embodiments any suitable means for fastening the housing together may be used such as glue, clips, bolts and so on.

Figure 3:
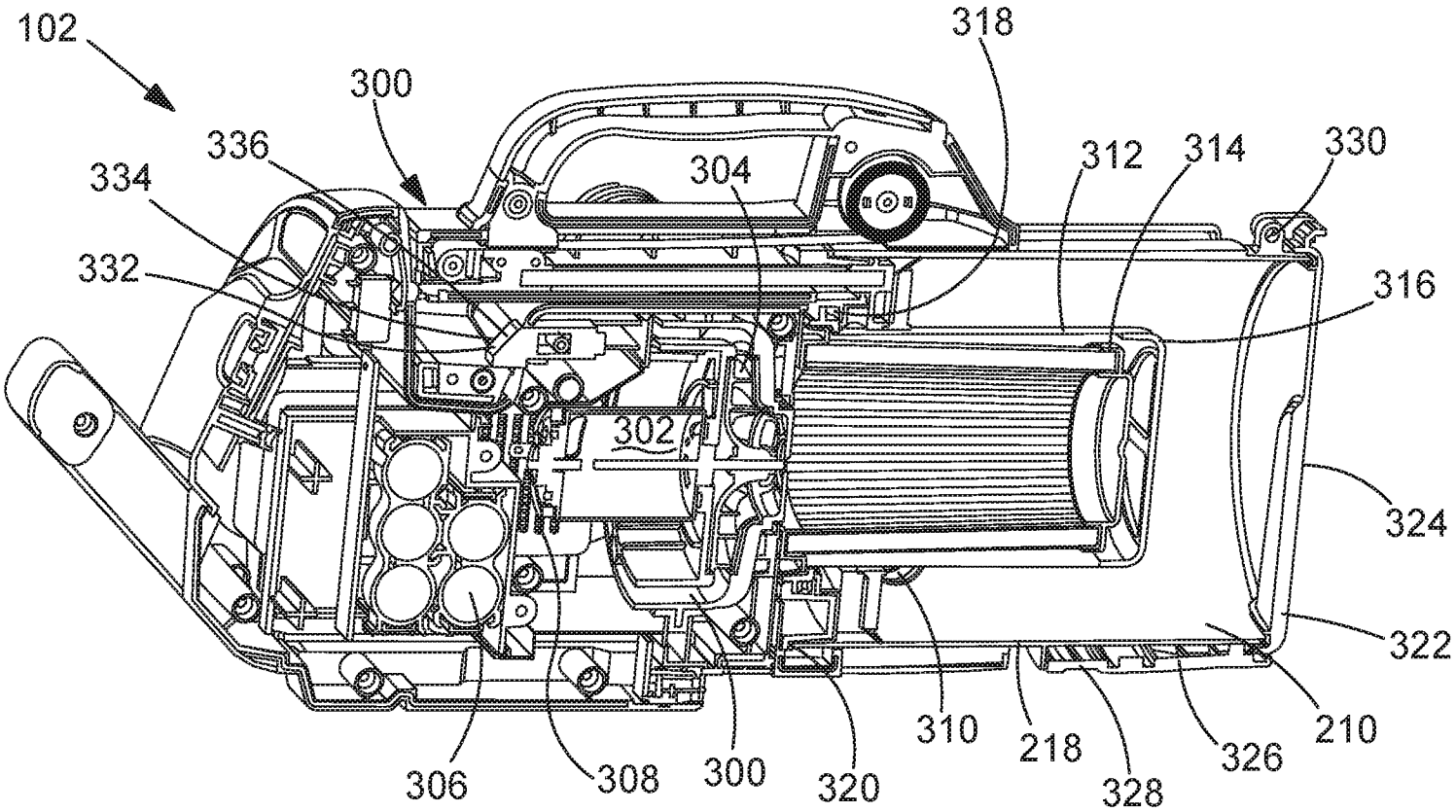
FIG. 3 shows a side cross sectional view of the vacuum cleaner.

The vacuum cleaner unit 102 comprises a motor fan assembly 300 which is best shown in FIG. 3. FIG. 3 shows a perspective cross section view of the vacuum cleaner unit 102. The motor fan assembly 300 comprises a motor 302 and a fan 304 for generating a negative pressure for sucking up dirt and debris via the dirty air inlet 204. The motor fan assembly 300 is housed within the housing 200 and electrically connected to a power source 306. The power source 306 is a battery comprising a plurality of battery cells. In other embodiments the vacuum cleaner unit 102 additionally or alternatively comprises a mains electricity supply (not shown).

The motor fan assembly 300 is actuated with a first switch 202. The first switch 202 is a main ON/OFF switch which controls power to the motor fan assembly 300.

Turning back to FIG. 2, the motor fan assembly 300 is in fluid communication with a dirty air inlet 204. The dirty air inlet 204 is coupled to a first end 206 of the hose 108 which couples to the floorhead 106 as shown in FIG. 1. The first end 204 of the hose 108 comprises a hose coupling mechanism 212. The hose coupling mechanism 212 selectively couples the first end 204 of the hose 108 to the floorhead 106. This means that the hose 108 does not accidentally come loose from the floorhead 106. Additionally the hose coupling mechanism 212 selectively couples the first end 204 to one or more accessories. The accessories that couple to the first end 204 can be one or more from the following; a brush, a crevice tool, a pet hair tool, a scrubber, an extension tube, a powered brush unit or any other suitable cleaning tool. The hose coupling mechanism 212 comprises a sprung biased pivoting latch 214. The latch 214 is biased to a locked position and when the user wishes to release the first end 204 from an accessory, the use depresses a button 216 and the latch moves to an unlocked position and disengages from the accessory permitting its removal. When the user releases the button 216, the latch snaps back into the locked position. The hose coupling mechanism 212 is optional and the first end 204 of the hose 108 may comprise any other suitable means for mounting accessories thereto. For example the accessories may screw fit or push friction fit on to the first end 204.

A second end 208 of the hose 108 is mounted to the housing 200 and in fluid communication with a dirt container 210. The second end 208 is mounted to an aperture 310 in a wall 218 of the dirt container 210. In this way there is an air flow pathway from the dirty air inlet 204 to the dirt container 210 and to the motor fan assembly 300. The motor fan assembly 300 exhausts clean air out via exhausts holes 308.

The second end 208 of the hose mounted on the wall of the dirt container 210 is better shown in FIG. 3. The dirt container 210 comprises a dirt separator 312 which is positioned in the airflow path between the dirty air inlet 204 and the motor fan assembly 300. The dirt separator 312 comprises a prefilter perforated shroud 316 which encloses a filter 314. For the purposes of clarity the individual perforations of the perforated shroud 316 are not shown. In some embodiments the dirt separator 312 comprises only either the perforated shroud 316 or the filter 314. Both the prefilter 316 and the filter 314 separate dirt and debris entrained in the air flow. The filter 314 is an air permeable pleated filter. The aperture 310 is mounted in the wall 218 of the dirt container 210 such that the air is inserted tangentially to the dirt container 210. This means that the air swirls around in the dirt container 210 before the air flow is sucked through the dirt separator 312. The air flow upstream of the dirt separator 312 is clean and air outputted from the motor fan assembly 300 does not contain any dirt or debris entrained in the air flow. In some embodiments the dirt separator 312 is not a pleated filter or a perforated shroud. Instead the dirt separator 312 is a cyclonic separator or a multistage cyclonic separator.

The dirt separator 312 is mounted in a lid 320 at a first end 318 of the dirt container 210. The lid 320 is sealed against the wall 218 of the dirt container 210 and comprises a hole there through for mounting the dirt separator 312. The lid 320 is sealed against the wall 218 of the dirt container 210 with a resilient member 402 (shown in FIG. 4*a*). The resilient member 402 is an annular rubber seal that is compressed between the lid 320 and the wall 218.

A second end 322 of the dirt container 210 comprises a hinged door 324. The door 324 is sprung biased and hinged at pivot 330. A door release mechanism 326 releases the door 324 from the dirt container 210. The door release mechanism 326 comprises a sprung biased pivoting latch 326. When a user presses the button 328 of the latch 326, the latch 326 moves into an unlocked position and the door 324 is urged by the spring in the pivot 330 into an open position.

In some embodiments the pivot 330 does not have a spring and the door is not sprung loaded. Instead the door 324 has a stop member 442 to ensure that the door only opens to a predetermined angle, for example 90 degrees of pivoting rotation with respect to the dirt container 210. The door also has a resilient detent 440 to ensure that the door will stay open when the user empties the dirt container 210. In this way the door 324 comprises a detent 440 for maintaining the door in an open position. In order for the user to close the door 324 the user pivots the door 324 until the detent 440 snaps out of position and the door 324 is free to pivot and be closed. Optionally the door 324 is spring biased and also comprises the detent 440 and the stop member 442.

When the door 324 is open, dirt and debris held in the dirt container 210 can be emptied into a bin. In other embodiments the door is not sprung biased. Furthermore the door release mechanism 326 is alternatively a clip (not shown) mounted on the door which engages with a reciprocal recess on the wall 218. Such a clip may be a living hinge. In yet another embodiment the dirt container 210 does not have a door at the second end 322. Instead the dirt container 210 is emptied by removing the lid 320 from the dirt container 210.

Optionally, the dirt container 210 is removeable from the vacuum cleaner unit 102. This means that the dirt container 210 can be removed from the housing 200 and emptied separately from the vacuum cleaner unit 102. This means that the user does not have to carry the entire vacuum cleaner unit 102 when emptying the dirt container 210. This makes emptying easier because the user does not have to lift the weight of the battery 306 and the motor fan assembly 300 when holding the dirt container 210 over the bin. The dirt container is selectively releaseable with a dirt container latch mechanism 332. The latch mechanism 332 is biased to a locked position and the latch 332 protrudes from the housing 200 into the dirt container 210. In order to release the dirt container 210 from the housing 200, the user actuates the dirt container latch mechanism 332 by pressing a button (not shown) which is mechanically coupled to the dirt container latch mechanism 332. Pressing the button moves the latch 334 from a locked position into an unlocked position. The latch 334 comprises a cammed surface 336 so that when the dirt container 210 is pushed back into the housing 200, the latch 332 snaps back into the locked position. The dirt container latch mechanism 332 is optional and the dirt container 210 may be held in the housing 200 with any other suitable means such as a push friction fit.

During use the dirt and debris sucked up at the dirty air inlet 204 is collected in the dirt container 210. In order to increase the effective volume in the dirt container 210, the dirt container 210 comprises a moveable dirt compactor 400. The moveable dirt compactor 400 will now be discussed in further detail with respect to FIGS. 4*a* and 4*b*.

Figure 4B:
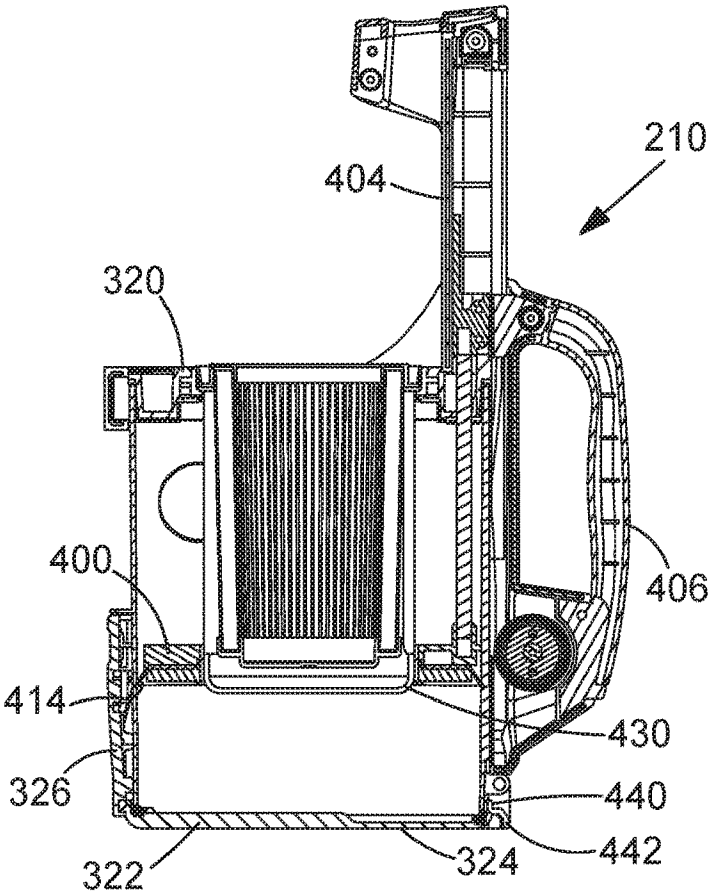
FIGS. 4*a* and 4*b* show side cross sectional views of the dirt container.
Figure 4A:
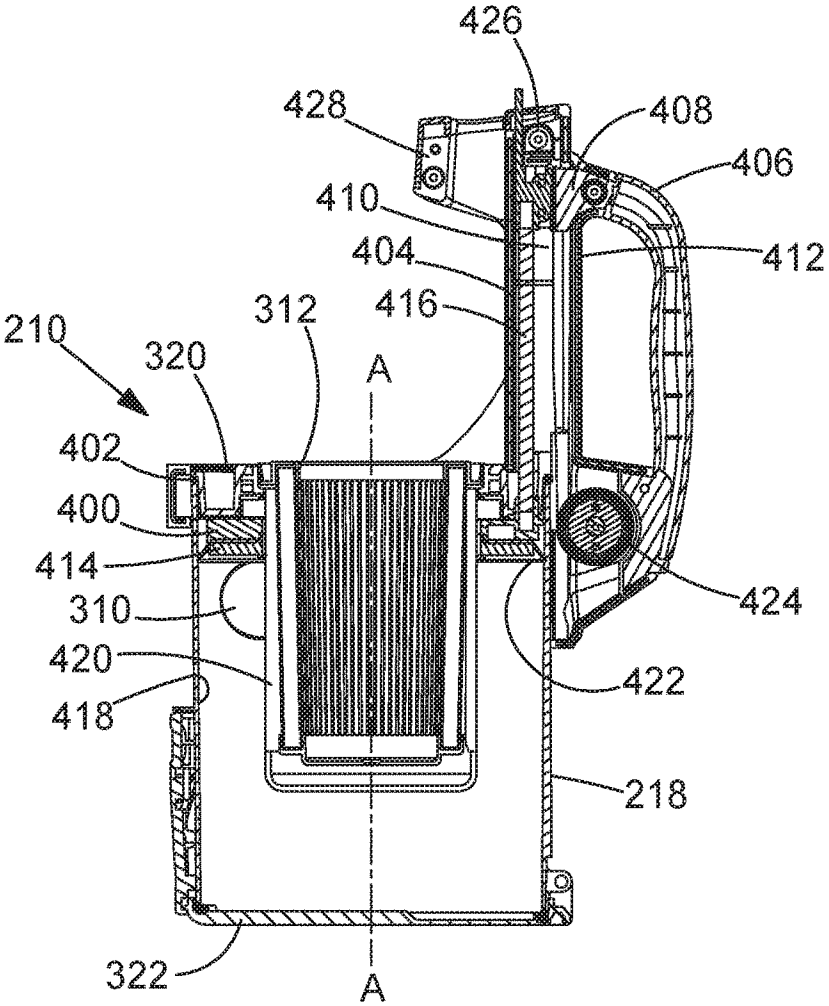

FIGS. 4*a* and 4*b* show a side cross section of the dirt container 210. The dirt container 210 has been removed from the vacuum cleaner unit 102. The dirt compactor 400 is operable when the dirt container has been removed from the vacuum cleaner unit 102. The dirt compactor 400 is also operable when the dirt container 210 is mounted in the vacuum cleaner unit 102.

FIG. 4*a* shows the dirt container 210 with the dirt compactor 400 in the stowed position. FIG. 4*b* shows the dirt compactor 400 in the compacting position during operation of the dirt compactor 400.

The dirt container 210 comprises an upstanding handle housing 404 projecting upwardly from the dirt container wall 218. The handle housing 404 is a hollow wall portion coupled to the wall 218 of the dirt container 210. The handle housing 404 comprises a slot 502 (best shown in FIG. 5*b*) for receiving a moveable primary handle 406. The moveable primary handle 406 is slidably mounted on in the slot 502 in the handle housing 404. The primary handle 406 is coupled to a handle mounting element 408 which slidably engages either side of the slot 502. In this way the handle mounting element 408 slides within an internal conduit 410 in the handle housing 404 and slides over an external wall 412 of the handle housing 404. This means that the handle mounting element 408 and the primary handle 406 are retained in the slot when the primary handle 406 is moved. The moveable primary handle 406 is moveable between a raised position and a lowered position.

FIG. 4*a* shows the handle 406 in a raised position which corresponds to the dirt compactor 400 in a stowed position. The stowed position is a position of the dirt compactor 400 that is not compressing the dirt and debris in the dirt container 210. FIG. 4*b* shows the handle 406 in a lowered position which corresponds to the dirt compactor 400 in a compacting position. The compacting position is a position of the dirt compactor 400 where dirt and debris in the dirt container 210 are urged towards an end 322 of the dirt container 210.

The primary handle 406 is mechanically coupled to a compression plate 414 (or 700) via an elongate linkage 416. The elongate linkage 416 is fixed to the handle mounting element 408 and is housed within the internal conduit 410. Accordingly movement of the primary handle 406 and the handle mounting element 408 causes a corresponding movement in the linkage 416 and the compression plate 414 (or 700).

In some embodiments the linkage 416 is a rigid rod. In alternative embodiments the linkage 416 can be any suitable means for mechanically coupling the primary handle 406 to the compression plate 414 (or 700).

Figure 7A:
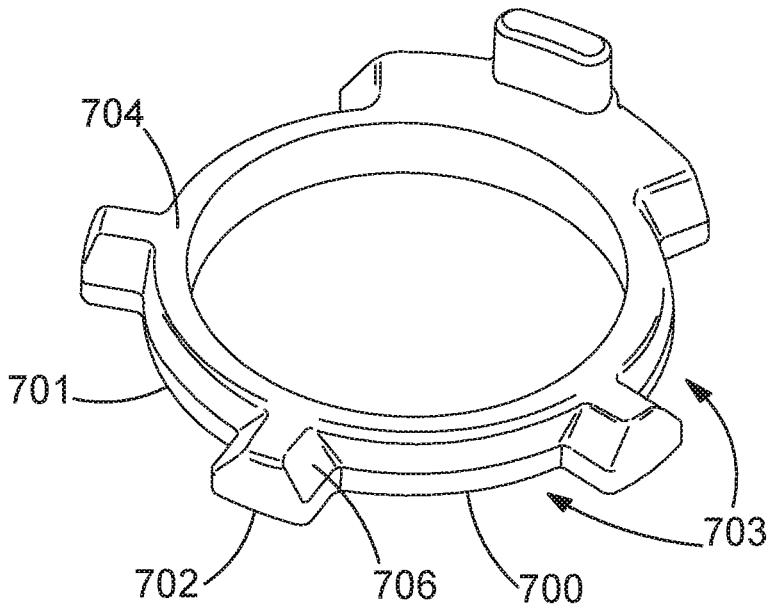
FIG. 7*a* shows a top perspective view of a dirt compactor.
Figure 7B:
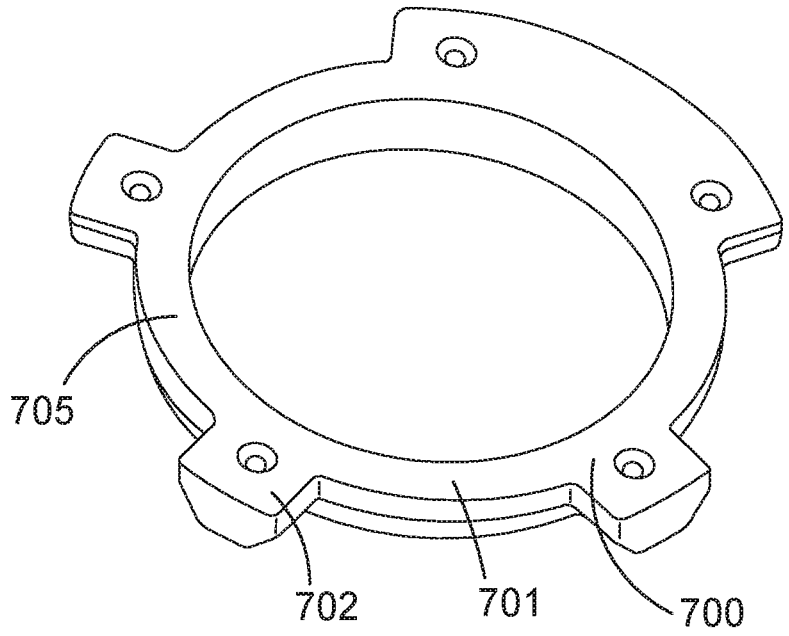
FIG. 7*b* shows a bottom perspective view of the dirt compactor.

The compression plate 414 is an annulus that surrounds the dirt separator 312 located in the middle of the dirt container 210. The dirt separator 312 protrudes through the centre of the annular compression plate 414 when the dirt compactor 400 is in the stowed position. The dirt separator 312 is cylindrical and a longitudinal axis of the cylindrical dirt separator 312 is aligned with the central axis A-A of the dirt separator 312. Likewise a centre of the annular compression plate 414 is also aligned with the centre of the dirt separator 312. In other embodiments the compression plate 414 is another shape such as a cog-shape (as shown in FIGS. 7*a* and 7*b* and discussed further below) or a circular cross section or any other suitable cross section. In the embodiment that the compression plate is circular, the filter or dirt separator 312 is mounted outside of the dirt container 210. In this way, the circular compression plate substantially fills the cross section of the dirt container 210 such that during operation of the dirt compactor 400 the compression plate exerts a force on substantially all the dirt and debris in the dirt container 210.

In alternative embodiments, the compression plate of the dirt compactor 400 may be shaped so as to allow some dirt to pass either side of the dirt compactor. This allows any dirt that may end up above the dirt compactor 400 to pass through and move below the dirt compactor 400. For example, the dirt compactor 400 may comprise a compression plate 700 that is shaped to have an annular section 701 with protruding sections 702 and open sections 703, so as to form a general cog-shape, as shown in FIGS. 7*a* and 7*b*. The open sections 703 allow any dirt above the dirt compactor 400 to fall through the open sections 703 to prevent dirt being trapped above the dirt compactor. The open sections 703 may be may be sized so that only a small proportion of dirt in the dirt chamber can pass through it when performing compaction. When performing compaction, the annular section 701 and protruding sections 702 urge the majority of the dirt and debris in the dirt container 210 towards end 322 of the dirt container 210.

Optionally dirt compression plate 414 engages both an internal surface 418 of the wall 218 of the dirt container and an exterior surface 420 of the dirt separator 312. The dirt compression plate 414 comprises a resilient sweeper 422 that sweeps along the internal surface 418 and the exterior surface 422. In some embodiments the resilient sweeper is a deformable member that is in constant contact with the surfaces 418, 420. The resilient sweeper 422 is a rubber membrane or additionally or alternatively a plurality of bristles. This means that as the compression plate 414 moves towards the second end 322, the resilient sweeper sweeps and/or brushes across the internal surface 418 of the wall 218 and the exterior surface 420 of the dirt separator 312. This means that any stubbornly fixed dirt will be removed from these surfaces every time the dirt compactor 400 is operated. Since the resilient sweeper 422 engages the perforated shroud 316 of the dirt separator 312, the perforations (not shown) in the shroud 316 are kept clean and improve the air flow efficiency of the vacuum cleaner unit 102.

In the embodiment of FIGS. 7*a* and 7*b*, dirt compression plate 700 may optionally engage the exterior surface 420 of the dirt separator 312. The dirt compression plate 700 may comprise a resilient sweeper and/or brush (not shown) that sweeps along the exterior surface 422 of the dirt separator 312. This means that as the compression plate 700 moves towards the second end 322, the resilient sweeper sweeps and/or brushes across the exterior surface 420 of the dirt separator 312. This means that any stubbornly fixed dirt will be removed from the surface of the dirt separator 312 every time the dirt compactor 400 is operated. Since the resilient sweeper engages the perforated shroud 316 of the dirt separator 312, the perforations (not shown) in the shroud 316 are kept clean and improve the air flow efficiency of the vacuum cleaner unit 102.

As mentioned above, the dirt compactor 400 is in the stowed position in FIG. 4A. In the stowed position, dirt compression plate 414 of the dirt compactor 400 is located in an uppermost position adjacent to the first end 318 of the dirt container and the lid 320. In this way, the position of the dirt compression plate 414 ensures that the maximum volume of the dirt container 210 is available for receiving the dirt and debris from the dirty air inlet 204. FIG. 4*a* shows the aperture 310 in the wall 218 of the dirt separator 210. The dirt compactor 400 is positioned in the stowed position such that the aperture 310 is between the dirt compression plate 414 and the second end 322. This means that during operation of the vacuum cleaner unit 102 when the dirt compactor 400 is in the stowed position, the dirt and debris entrained in the air flow is not received in the dirt container 210 between the first end 320 and the dirt compression plate 414. Keeping the dirt between the dirt compression plate 414 and the second end 322 prevents a build-up of hard to remove dirt which will interfere and damage the dirt compactor 400.

In some scenarios (e.g., when the dirt comprises very fine dust or there is an imperfect seal between the compression plate 414 and the dirt container 210 or dirt separator 312), some dirt may become trapped in the dirt container 210 between the first end 320 of the dirt container 210 and the dirt compactor 400. This problem can be solved by providing an opening or passage for dirt to pass through the dirt compactor from the side of the first end 320 towards the second end 322, e.g., by providing a dirt compactor 400 with the compression plate 700 shown in FIGS. 7*a* and 7*b*.

The primary handle 406 is optionally biased to the raised position. This means that the dirt compactor 400 is biased to the stowed position. The primary handle 406 comprises an internal spring 424 which is coupled to the handle housing 404 at peg 426. The spring 424 is a constant force coil spring. This means that the user only has to exert the same force on the primary handle irrespective of whether the primary handle 406 is in the raised position or the lowered position or somewhere in between. The internal spring 424 is threaded through the internal conduit 410. In some embodiments the biasing can be achieved with any suitable biasing means such as a coil spring, a leaf spring and so on. The biasing element can be located in any suitable position in the vacuum cleaner unit 102 for biasing the dirt compactor 400 and the primary handle 406. For example in some embodiments rather that the primary handle 406 being biased, the compression plate 414 (or 700) can be coupled to the lid 320 with a biasing means such as a spring. In some embodiments there is no biasing element and the primary handle 406 is moved between the lowered position and the raised position manually by the user.

In addition to the primary handle 406 the handle housing 404 comprises a secondary handle 428. The secondary handle 428 is formed from a through hole in the handle housing. The secondary handle 428 permits the user to grip the dirt container 210 whilst also holding the primary handle 406.

Operation of the compactor 400 will now be discussed. The user grips the secondary handle 428 whilst holding the primary handle 406. The user pushes the primary handle 406 down, towards the second end 322 of the dirt container. The user moves the primary handle 406 from the raised position shown in FIG. 4*a* to the lowered position shown in FIG. 4B. This moves the dirt compactor 400 from the stowed position shown in FIG. 4A to the compacting position shown in FIG. 4B.

As the primary handle 406 moves down, the dirt compression plate 414 urges dirt between the dirt separator 312 and the wall 218 towards the second end 322. The dirt compression plate 414 squeezes the dirt between the compression plate 414 and the second end 322. In the compacting position, the compression plate 414 (or 700) is adjacent to an end 430 of the dirt separator 312. This means that the annular compression plate 414 (or 700) moves substantially along the entire length of the dirt separator 312 and the resilient sweeper 422 sweeps all of the exterior surface 420 of the dirt separator 312.

The user then releases the primary handle 406 which returns to the raised position and the dirt compression plate 414 (or 700) to the stowed position. This creates free space in the dirt container 210 and the user can continue to user the vacuum cleaner unit 102 without emptying the dirt container 210.

Optionally the user can actuate the dirt compactor 400 with the door 324 in the open position. The door 324 is opened with the latch 326 as described above. In this way the dirt compactor 400 is used to urge the dirt out of the dirt container 210 when emptying. In particular the annular dirt compression plate 414 is useful for removing debris that may become stuck between the exterior surface 420 of the dirt separator 312 and the internal surface of the wall 218. This means the user avoids having to user their fingers to remove bits of accumulated hair covered in dust and the like from the dirt container 210 when emptying.

Figure 5B:
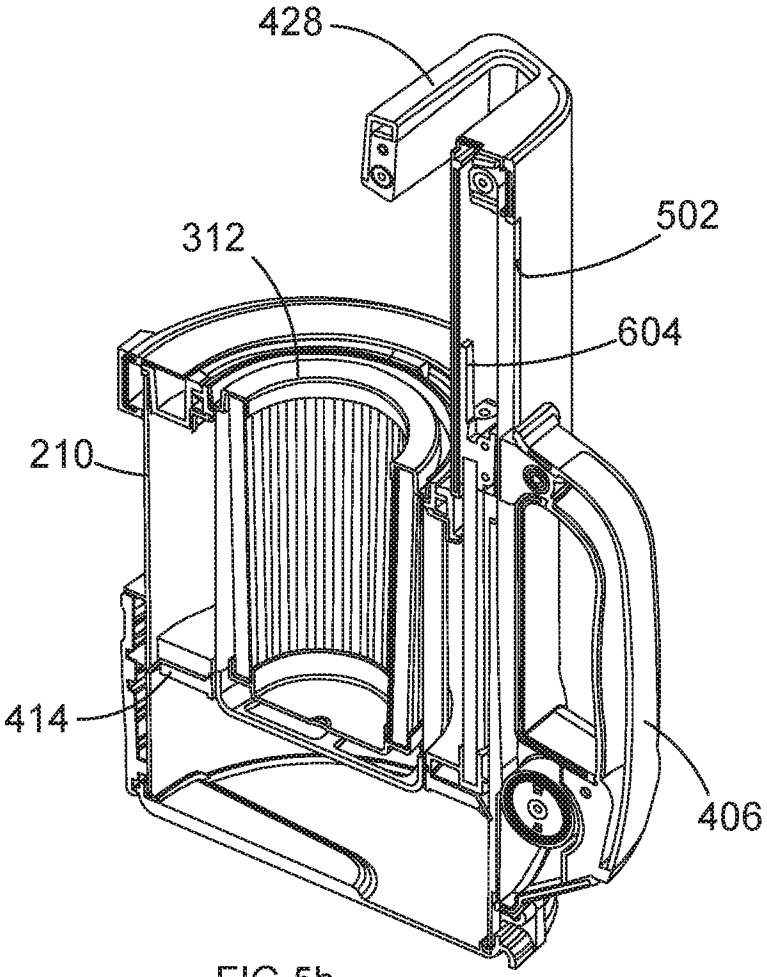
FIGS. 5*a* and 5*b* show perspective cross sectional views of the dirt container.
Figure 5A:
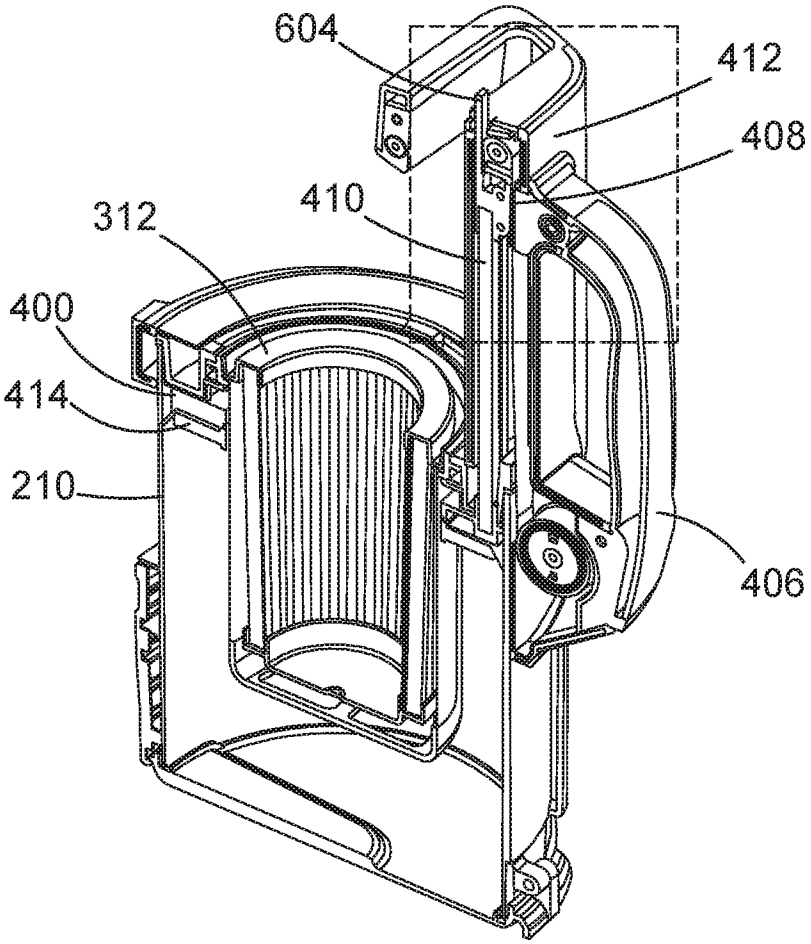

FIGS. 5A and 5B also respectively show the dirt container 210 with the dirt compactor 400 in the stowed position and the compacting position. FIGS. 5A and 5B show a perspective cross section of the dirt container 210.

As mentioned previously the aperture 310 is mounted in the wall 218 of the dirt container 210 between the dirt compression plate 414 (or 700) and the second end 322. However when the dirt compactor 400 is moved into the compacting position, the dirt compaction plate 414 (or 700) moves past the aperture 310. This means that the aperture 310 is located between the dirt compaction plate 414 and the first end 320 when the dirt compactor 400 is in the compacting position. Accordingly it is undesirable for the motor fan assembly 300 to generate an airflow with dirt and debris entrained therein to be input when the dirt compactor 400 is in the dirt compacting position. This is because the dirt and debris will accumulate underneath the lid 320 and the dirt can contaminate the dirt compaction mechanism and require maintenance.

Figure 6B:
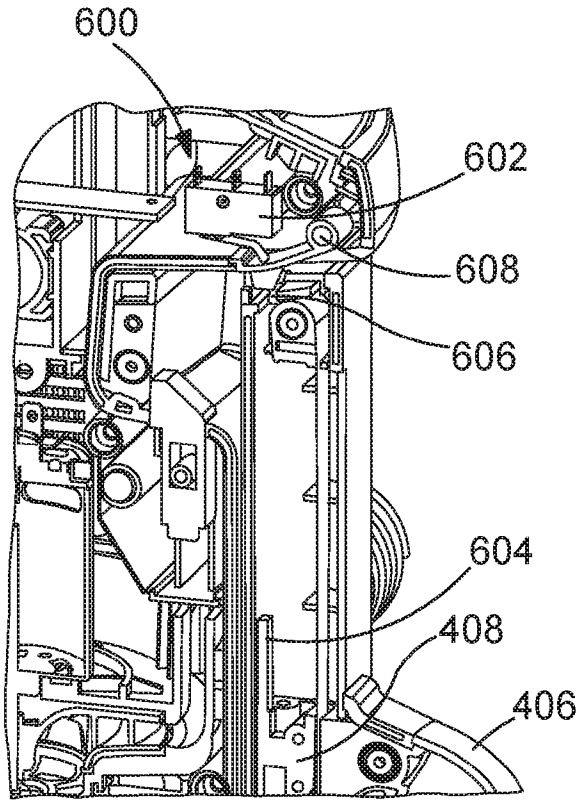
FIGS. 6*a* and 6*b* show a close up cross sectional view of the vacuum cleaner.
Figure 6A:
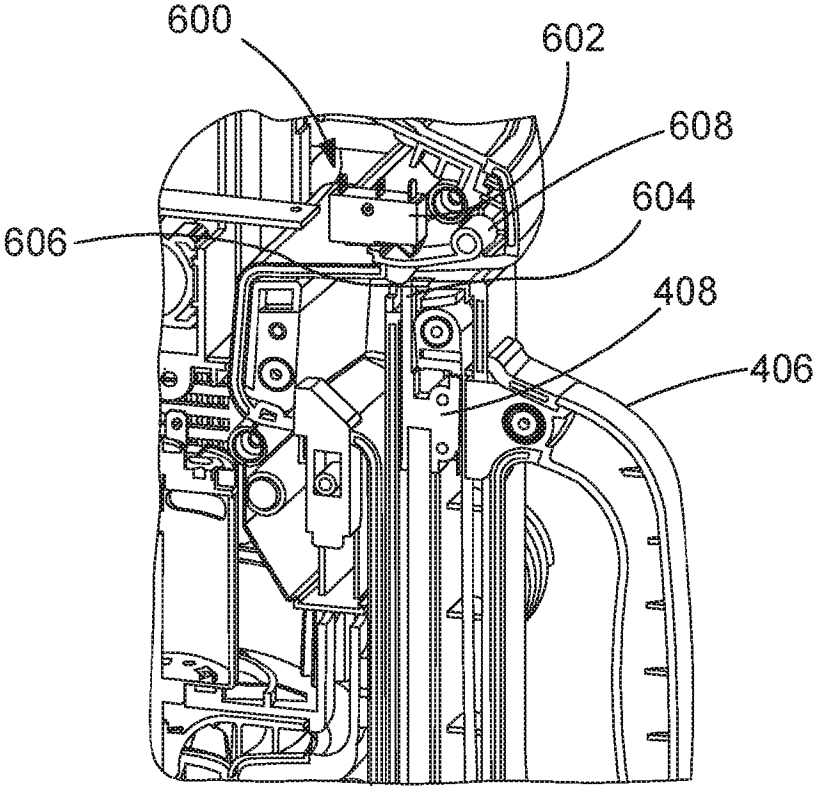

The arrangement to prevent dirt and debris contaminating the dirt compactor 400 will now be discussed in further detail with respect to FIGS. 6*a* and 6*b*. FIGS. 6*a* and 6*b* respectively show a close up perspective cross section of the dirt vacuum unit 102 with the dirt compactor 400 in the stowed position and the compacting position. The close up representations of the vacuum cleaner unit 102 are indicated by the dotted box in FIG. 5*a*.

FIGS. 6*a* and 6*b* also show the dirt container 210 mounted in the housing 200 of the vacuum cleaner unit 102. The vacuum cleaner unit 102 comprises a detector switching mechanism 600 for selectively interrupting power to the motor fan assembly 300. The detector switching mechanism 600 is arranged to detect the presence of the dirt container 210 being mounted in the housing 200. The switching mechanism 600 comprises an electrical switch 602 which is in electrical series connection with the electrical circuit comprising the ON/OFF switch 202, the motor fan assembly 300 and the battery 306.

The detector switching mechanism 600 is configured to close the electrical circuit and supply power to the motor fan assembly 300 when the moveable dirt compactor 400 is in the stowed position.

FIG. 6*a* shows the electrical switch 602 in the ON position such that power is supplied from the battery 306 to the motor fan assembly 300 when the main ON/OFF switch 202 is in the ON position.

The electrical switch 602 is actuated by a projecting switching arm 604. The projecting switching arm 604 is mounted on the handle mounting element 408. Accordingly the projecting switching arm 604 moves up and down when the primary handle 406 and the handle mounting element 408 moves between the raised position and the lowered position.

When the primary handle 406 is in the raised position, the projecting switching arm 604 projects up from the handle housing 404. The projecting switching arm 604 can be seen in FIG. 4*a* as well. When the dirt container 210 is mounted in the housing 200, the projecting switching arm 604 protrudes through a hole 606 in the housing. The projecting arm engages and pivots a pivoting arm 608. The pivoting arm 608 pivots and actuates the electrical switch 602 when the projecting arm 604 pushes against the pivoting arm 608. In this way the pivoting arm 608 pivots between an engagement position and a disengagement position and actuates the electrical switch 602 accordingly. The engagement position and the disengagement position of the pivoting arm 608 are respectively shown in FIGS. 6*a* and 6*b*.

FIG. 6*b* shows the primary handle 406 in the lowered position. The linkage 416 and the handle mounting element 408 are also lowered and moved away from the pivoting arm 608 and the electrical switch 602. Accordingly the projecting switching arm 604 is remote from the electrical switch 602 when the primary handle 406 is in a lowered position. The electrical switch 602 is biased to the open position and therefore the power supplied to the motor fan assembly 300 is interrupted when the primary handle 406 is moved to a lowered position.

In some embodiments the electrical switch is a microswitch. In other embodiments the electrical switch 602 is any suitable electrical element for interrupting the electrical supply to the motor fan assembly 300. For example the electrical switch 602 can be a relay, transistor or the projecting switching arm 604 can itself be an electrical connection of the switch. As can be seen from FIGS. 6A and 6B the switching mechanism is partly on the dirt container 210 and the housing 200. In other embodiments, the switching mechanism is wholly comprised within the dirt container 210. In the instance where the switching mechanism is in the dirt container 210, there are electrical connections between the dirt container 210 and the housing 200.

Alternatively or additionally the detector switch can be other types of detectors such as an optical detector to optically detect the projecting switching arm 604, or a moving magnet on the projecting switching arm 604 and a hall sensor in the housing 200, a reed switch in the housing 200 and a moving magnet on the projecting switching arm 604 or any other electrical sensor to detect movement of the dirt compactor. In other embodiments the detector switch 602 is a sensor part of an electronic detection circuit comprising a microprocessor. In this instance the microprocessor controls the power supply to the motor fan assembly in dependence on the sensor output.

The arrangement shown in FIGS. 6A and 6B means that the motor fan assembly is not in operation when the dirt compactor 400 is in the compacting position. Furthermore the motor fan assembly 300 is not operable when the dirt container 210 is removed from the housing 200. This means that an airflow cannot be sucked into the motor fan assembly without first passing through the dirt separator 312.

As mentioned above, in some scenarios, some dirt may become trapped in the dirt container 210 between the first end 320 and the dirt compactor 400. In such cases, a build-up of dirt may prevent the dirt compactor 400 from returning to the stowed position because the top surface of the dirt compactor abuts against the dirt build-up. This, in turn, may prevent switching arm 604 from protruding through hole 606 in the housing and engaging the pivoting arm 608, which actuates the electrical switch 602. Thus, the build-up of dirt above the dirt compactor 400 could lead to an unintended interruption to the electrical supply to the motor fan assembly 300. One way of solving this problem is to provide a dust compactor that allows dirt located on one side of the compactor to pass through to the other side of the dirt compactor. FIG. 7*a* shows a top view of an example of such a dirt compactor and FIG. 7*b* shows a bottom view of the dirt compactor. As mentioned above, the dirt compactor has open sections 703 through which dirt can pass. Other suitably shaped dirt compactors that allow dirt to pass through may be provided such as an annular or circular dirt compactor with a plurality of holes in them to allow dirt to pass through. In the upright type vacuum cleaner described herein, the dirt can move under gravity and, when in use, under the pull of the vacuum from above the dirt compactor, through the open sections and below the dirt compactor.

As shown in FIG. 7*a*, the top surface 704 of the dirt compactor has a greater surface area than the bottom surface 705 of the dirt compactor. This helps reduce the contact area of the dirt compactor with the first end 320 of the inside of the dirt container 210 and thus helps reduce the amount of dirt that can be trapped between them. As shown in FIG. 7*a*, one optional way of achieving the surface area difference is by providing sloping surfaces or sections 706 between the top surface 704 and the bottom surface 705. The sloping surface 706 also helps the dirt to roll or fall off the dirt compactor.

During operation, as dirt fills the dirt container 210, the dirt tends to bind to itself. When compacting, the annular section 701 and protruding sections 702 are able to push down the dirt directly below those sections and also pull down significant dirt directly below the open sections 703 as that dirt has bound to the dirt that is being pushed down. Thus, even with the open sections 703, the dirt compactor is able to compact and move the majority of dirt towards end 322.

In another embodiment two or more embodiments are combined. Features of one embodiment can be combined with features of other embodiments.

Embodiments of the present invention have been discussed with particular reference to the examples illustrated. For example in one embodiment the primary handle is optional and the actuation of the dirt compactor is operated with other mechanism. A lever (not shown) is provided that is pivotally mounted on the dirt container 210 and pivotally movement of the lever translates into movement of the dirt compactor 400. Alternatively the dirt compactor 400 is actuated with a motorised gear mechanism (not shown) which can be automated or the user can selectively actuate. For example the dirt compactor 400 is threaded on a rotating central rod (not shown) powered by the motorised gear mechanism and the dirt compression plate 414 or 700 travels up and down the rotating central rod as the rod rotates.

However it will be appreciated that variations and modifications may be made to the examples described within the scope of the invention.

The invention claimed is:

1. A vacuum cleaner comprising:

a housing;

a motor fan assembly mounted in the housing, the motor fan assembly arranged to generate an air flow;

a dirt container mountable on the housing and in fluid communication with a dirty air inlet and the motor fan assembly;

a moveable dirt compactor mounted in the dirt container and moveable between a stowed position and a dirt compacting position wherein the moveable dirt compactor is closer to one end of the dirt container in the dirt compacting position than in the stowed position;

wherein the vacuum cleaner comprises a detector switch coupled to the moveable dirt compactor, the detector switch configured to open an electrical circuit and interrupt power supplied to the motor fan assembly when the moveable dirt compactor moves towards the dirt compacting position and urges dirt towards the one end of the dirt container.

2. The vacuum cleaner according to claim 1 wherein the detector switch is configured to close the electrical circuit and supply power to the motor fan assembly when the moveable dirt compactor is in the stowed position.

3. The vacuum cleaner according to claim 1 wherein the moveable dirt compactor is coupled to the detector switch with an elongate mechanical linkage.

4. The vacuum cleaner according to claim 1 wherein the vacuum cleaner comprises a dirt separator mounted in the dirt container is located in an air flow path between the dirty air inlet and the motor fan assembly.

5. The vacuum cleaner according to claim 4 wherein the moveable dirt compactor sweeps a surface of the dirt separator when the moveable dirt compactor moves from the stowed position to the dirt compacting position.

6. The vacuum cleaner according to claim 1 wherein the moveable dirt compactor engages an inner surface of the dirt container.

7. The vacuum cleaner according to claim 1 wherein the dirty air inlet is mounted on a wall of the dirt container between the moveable dirt compactor in the stowed position and the one end of the dirt container.

8. The vacuum cleaner according to claim 1 wherein the moveable dirt compactor is actuated with a moveable handle mounted on the exterior of the dirt container.

9. The vacuum cleaner according to claim 1 wherein the moveable dirt compactor is biased towards the stowed position.

10. The vacuum cleaner according to claim 9 wherein a spring is mounted in the handle for biasing the moveable dirt compactor to the stowed position.

11. The vacuum cleaner according to claim 1 wherein the one end of the dirt container comprises a door for emptying the dirt container.

12. The vacuum cleaner according to claim 11 wherein the door comprises a detent for maintaining the door in an open position and the dirt container comprises a first latch for releasing the door.

13. The vacuum cleaner according to claim 12 wherein the dirt container is removeable from the housing.

14. The vacuum cleaner according to claim 13 wherein the detector switch is mounted in the housing.

15. The vacuum cleaner according to claim 13 wherein the housing comprises a second latch for releasing the dirt container from the housing.

16. A vacuum cleaner comprising:

a housing;

a motor fan assembly arranged to generate an air flow;

a dirt container in fluid communication with a dirty air inlet and the motor fan assembly;

a moveable dirt compactor mounted in the dirt container and moveable between a stowed position and a dirt compacting position wherein the moveable dirt compactor is closer to one end of the dirt container in the dirt compacting position than in the stowed position, wherein the movable dirt compactor is shaped so as to allow dirt within the dirt container located on one side of the dirt compactor to pass to the other side of the dirt compactor; and a detector switch coupled to the moveable dirt compactor, the detector switch configured to open an electrical circuit and interrupt power supplied to the motor fan assembly when the moveable dirt compactor moves towards the dirt compacting position and urges dirt towards the one end of the dirt container.

17. The A vacuum cleaner according to claim 16, wherein the movable dirt compactor comprises a top surface and a bottom surface, the bottom surface having a greater surface area than the top surface.

18. The vacuum cleaner according to claim 17, wherein at least a portion of the top surface contacts the dirt container when the movable dirt compactor is in the stowed position.

19. The vacuum cleaner according to claim 17, wherein the dirt compactor comprises one or more sloping surfaces between the top surface and the bottom surface.

20. The vacuum cleaner according to claim 16, wherein the dirt compactor comprises one or more open sections or holes for dirt to pass through.

* * * * *